US011332289B2

(12) United States Patent
Watanabe

(10) Patent No.: US 11,332,289 B2
(45) Date of Patent: May 17, 2022

(54) SEALED CONTAINER, A PACKING, AND PACKING-EQUIPPED LID BODY

(71) Applicant: KOTODO TAKAHASHI CORPORATION, Tokyo (JP)

(72) Inventor: Noriko Watanabe, Matsudo (JP)

(73) Assignee: KOTODO TAKAHASHI CORPORATION, Tokyo (JP)

( * ) Notice: Subject to any disclaimer, the term of this patent is extended or adjusted under 35 U.S.C. 154(b) by 0 days.

(21) Appl. No.: 17/439,131

(22) PCT Filed: Aug. 24, 2020

(86) PCT No.: PCT/JP2020/031760
§ 371 (c)(1),
(2) Date: Sep. 14, 2021

(87) PCT Pub. No.: WO2021/039684
PCT Pub. Date: Mar. 4, 2021

(65) Prior Publication Data

US 2022/0089339 A1 Mar. 24, 2022

(30) Foreign Application Priority Data

Aug. 26, 2019 (JP) ..... JP2019-153412

(51) Int. Cl.
*B65D 53/04* (2006.01)
*B65D 43/02* (2006.01)

(52) U.S. Cl.
CPC ..... *B65D 53/04* (2013.01); *B65D 43/0218* (2013.01); *B65D 2543/005* (2013.01);
(Continued)

(58) Field of Classification Search
CPC .... B65D 2543/00092; B65D 2543/005; B65D 2543/00537; B65D 2543/00981; B65D 41/045; B65D 43/0218; B65D 53/04
(Continued)

(56) References Cited

U.S. PATENT DOCUMENTS 4,251,002 A * 2/1981 Middleton ..... B65D 43/0256 215/253
9,027,774 B2 * 5/2015 Palmer ..... A47G 19/2272 220/802
2009/0050626 A1 * 2/2009 Bock ..... B65D 53/02 220/254.1

FOREIGN PATENT DOCUMENTS

JP H02-135463 U 11/1990
JP H07-315416 A 12/1995
(Continued)

OTHER PUBLICATIONS

Oct. 27, 2020 International Search Report issued in International Patent Application No. PCT/JP2020/031760.
(Continued)

*Primary Examiner* — Don M Anderson
*Assistant Examiner* — Madison L Poos
(74) *Attorney, Agent, or Firm* — Oliff PLC

(57) ABSTRACT

A sealed container capable of knowing that the opening of the container body is exactly in close contact with a packing when a lid body is attached to the container body. The sealed container has a container body, a lid body attached to the opening of the container body, and a packing attached to the lid body, while the packing has a packing body provided in the lid body and a plurality of flexible ring-shaped protrusions provided thereupon which are mutually separated in the axial direction of the lid body The outer peripheral portion of the ring-shaped protrusion, which is the farthest from the top plate portion of the lid body in the axial
(Continued)

direction, is in close contact with the inner peripheral surface of the container body, while the outer peripheral portions of other ring-shaped protrusions are radially separated from the inner peripheral surface of the container body.

5 Claims, 2 Drawing Sheets

(52) U.S. Cl.
CPC ..... *B65D 2543/00092* (2013.01); *B65D 2543/00537* (2013.01); *B65D 2543/00981* (2013.01)

(58) Field of Classification Search
USPC ..... 220/801–803
See application file for complete search history.

(56) References Cited

FOREIGN PATENT DOCUMENTS

| | | | |
|---|---|---|---|
| JP | 2002-249158 | A | 9/2002 |
| JP | 2011-173597 | A | 9/2011 |
| JP | 2018-509257 | A | 4/2018 |

OTHER PUBLICATIONS

Oct. 27, 2020 Written Opinion of the International Searching Authority issued in International Patent Application No. PCT/JP2020/031760.

* cited by examiner

[FIG. 1]
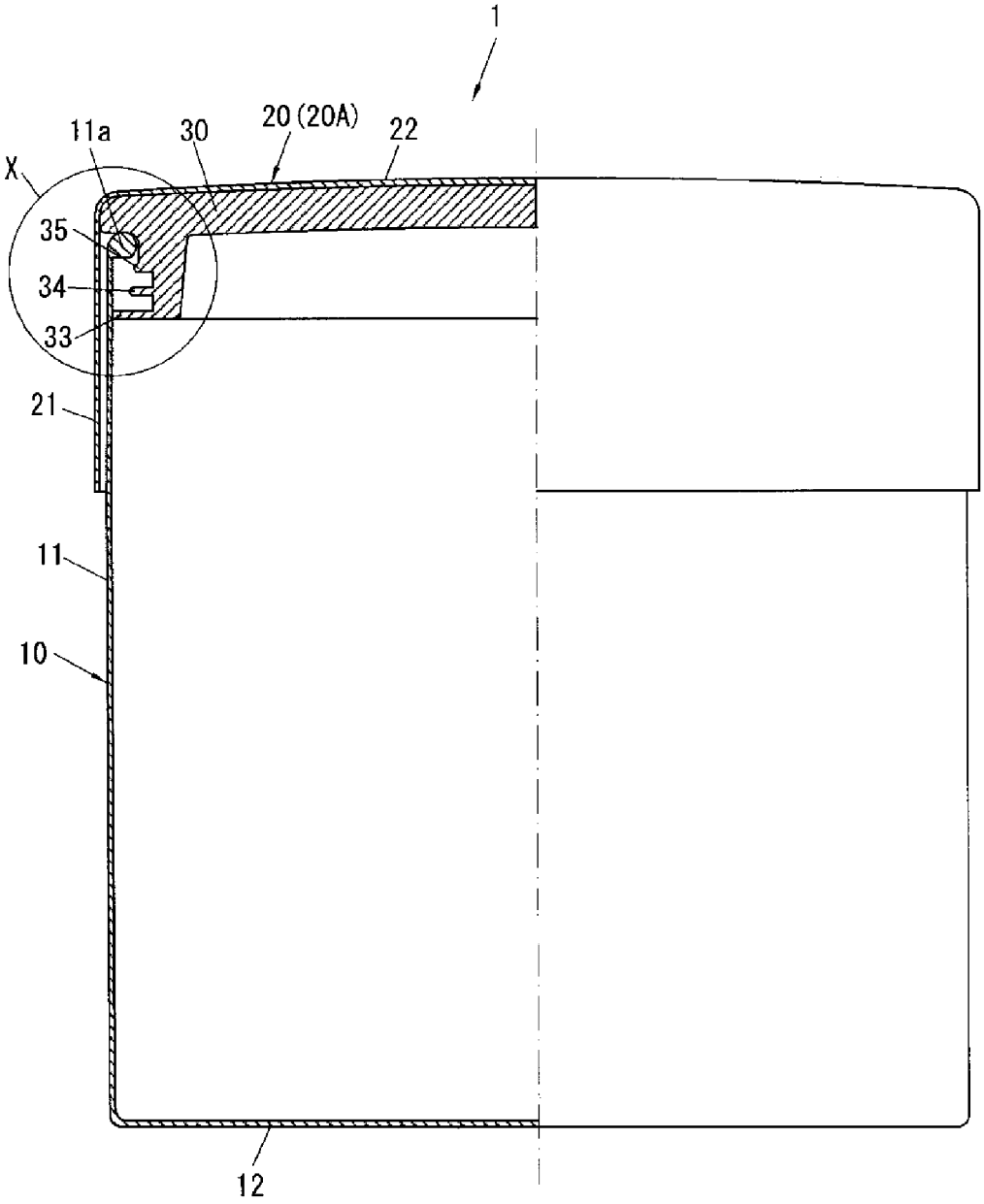

[FIG. 2]
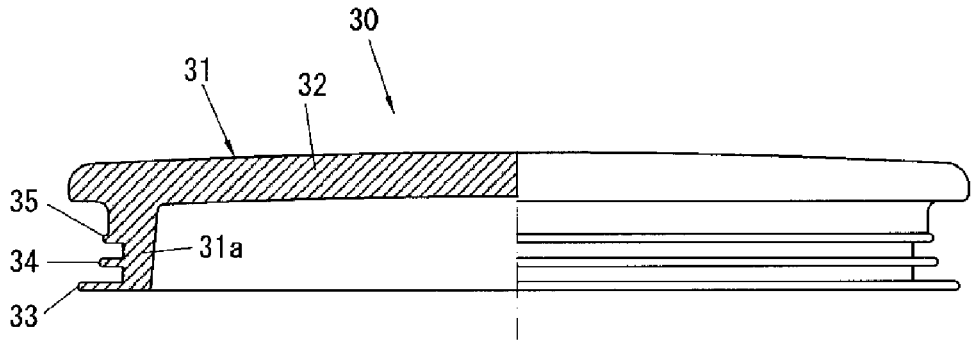
[FIG. 3]
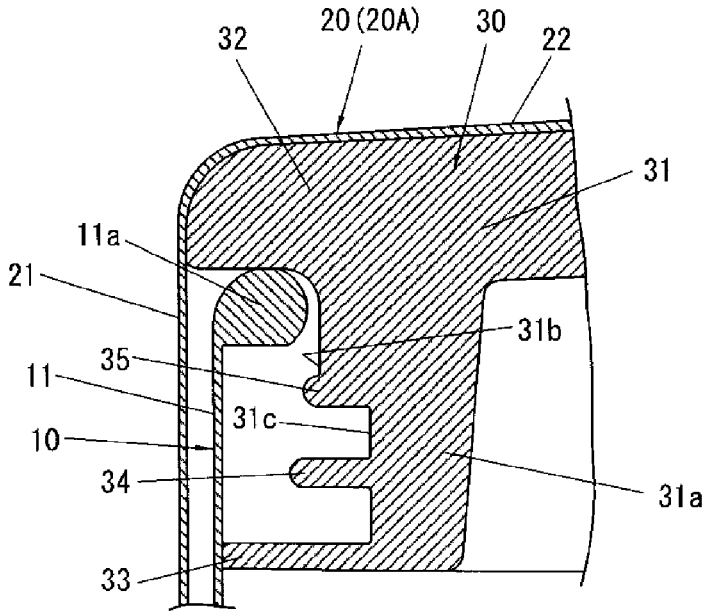

SEALED CONTAINER, A PACKING, AND PACKING-EQUIPPED LID BODY

TECHNICAL FIELD

The present invention relates to a sealed container for accommodating articles in a sealed state, a packing, and a packing-equipped lid body.

BACKGROUND ART

There has been known a sealed container in which a packing is interposed between the container body and the lid body to improve a hermeticity (airtightness, watertightness, and the like). Such a sealed container can accommodate, in a sealed state, contents including volatile components such as cosmetics, chemicals, foods, as well as components which deteriorate or disintegrate by touching a moisture or outside air, thus avoiding a deterioration or disintegration in an accommodated content, providing an improved preservation, and further preventing a leakage of a volatile component.

A packing for use in a sealed container is preferably softer than the lid body from the viewpoint of an improved adhesion to the mouth (opening) of the container, and is usually manufactured separately from the lid before being attached to the inside of the lid body.

Patent Document 1 has disclosed a sealed container using such a packing.

Such a sealed container has a container body including a housing part, a lid body to be attached to the mouth portion of the container body, and a packing attached to the inside of the lid body. Further, a convex portion that stops the outer circumference of the packing is formed on the inner surface of the lid. Here, the packing includes a central region having a shape in which the cross-section thereof is convexly curved upwardly. Such a packing is held in the lid body by fixing its outer circumference to the convex portion

CITATION LIST

Patent Document

Patent Document 1: Japanese Unexamined Patent Publication No. 2011-173597.

SUMMARY OF THE INVENTION

Technical Problems

On the other hand, when attaching a packing-equipped lid body to a container body, there is a requirement that a human operator usually wants to know whether or not a sealing effect is guaranteed by the packing.

Conventionally, when attaching a packing-equipped lid body to a container body, one often worries about whether or not the mouth portion (opening) of the container is closely attached to the packing, and whether or not one can obtain a certain feeling that the lid has been properly attached to the container.

The inventor of the present invention have reached the present invention based on the following experiences. Namely, when a lid body has been attached to a container body, not only is it possible to feel that the opening of the container has been exactly attached to the packing, but it is also possible to know the same fact by finding a sort of sound that has been emitted. After an extensive research on the structure of packing, it has been found that if the packing has a configuration including a plurality of ring-shaped protrusions and if the ring-shaped protrusions are set under certain conditions, it is possible to produce a bursting sound when the opening of the container body is in close contact with the packing.

The present invention has been accomplished based on the above findings, and it is an object of the present invention to provide a sealed container, a packing, and a lid body equipped with the packing so configured that when the lid body is attached to the container body, it can be surely known that the opening of the container body is in close contact with the packing.

Solution to Problems

To solve the above problems, the present invention has provided an improved sealed container including a bottomed cylindrical container body, a ceiling-equipped cylindrical lid body attached to an opening of the container body, and a packing attached to the lid body, wherein the packing has a packing body provided in the lid body and a plurality of flexible ring-shaped protrusions provided on the packing body so as to be mutually separated in the axial direction of the lid body and protrude in a radial direction, the outer peripheral portion of one of the ring-shaped protrusions, which is farthest from a top plate portion of the lid body in the axial direction, is in close contact with the inner peripheral surface of the container body, and at least one of other ring-shaped protrusions has its outer peripheral portion to be radially separated from the inner peripheral surface of the container body and to be located radially outwardly beyond the tip edge of the ring-shaped overhanging portion, which has been formed protruding radially inwardly in the opening edge portion of the container body.

According to the present invention there has also been provided a packing for being attached to a ceiling-equipped cylindrical lid body, comprising:

a packing body to be provided in the lid body;

a plurality of flexible ring-shaped protrusions provided on the packing body so as to be mutually separated in the axial direction of the lid body and protrude in a radial direction, wherein the diameter of the outer peripheral portion of one ring-shaped protrusion, which is farthest from the top plate portion of the lid body in the axial direction, is larger than the diameters of the outer peripheral portions of other ring-shaped protrusions.

Further, the packing-equipped lid body of the present invention includes: a cylindrical lid body; and the packing attached to the lid body.

On the other hand, although the packing is provided inside the lid body, this only means that the packing is provided on at least a part of the inner surface of the lid body, but also means to include a case where the packing may be provided on the opening edge of the lid body.

In the present invention, the packing includes a packing body, and a plurality of flexible ring-shaped protrusions provided on the packing body and in a radially protruding state, and arranged mutually separately in the axial direction of the lid body from the top plate portion of the lid body. The outer peripheral portion of a ring-shaped protrusion, which is the farthest from the top plate portion, is in close contact with the inner peripheral surface of the container body, and the outer peripheral portions of other ring-shaped protrusions are in close contact with the inner peripheral surface of the container body, while the outer peripheral portions of other ring-shaped protrusions are radially separated from the inner peripheral surface of the container body. Further, since the outer peripheral portions of other ring-shaped protrusions are located radially outwardly beyond the tip edge of the ring-shaped overhanging portion (which has been formed projecting radially inwardly to the opening edge portion of the container body), rendering it possible to produce a bursting sound when the lid body is attached to the container body. Therefore, it can be known that the opening of the container body has been surely brought into close contact with the packing by this bursting sound, thus making it possible to know that the airtightness has been guaranteed for the sealed container.

In this way, although it is difficult to confirm in detail the mechanism of the bursting sound, the outer peripheral portion of a ring-shaped protrusion (which is spaced apart farthest from the top plate portion of lid body in the axial direction) is in close contact with the inner peripheral surface of the container body, while the outer peripheral portion of the ring-shaped protrusion will get close to other ring-shaped protrusions by virtue of the flexibility of the ring-shaped protrusion. At this time, the air between the packing and the container body is compressed, and when the outer peripheral portions of other ring-shaped protrusions move beyond the overhanging portion of the container body, the outer peripheral portions of other ring-shaped protrusions will be elastically bent and then elastically restored. In this way, this other ring-shaped protrusion will vibrate, and the compressed air will pass between the outer peripheral portion of the container body and the inner peripheral portion of the lid body to escape to the outside, thereby making it possible to presume that the above-mentioned bursting sound has been emitted.

Further, according to the above configuration of the present invention, three ring-shaped protrusions are provided, and such three ring-shaped protrusions may have the diameters of their outer peripheral portions to be smaller when getting closer to the top plate portion.

Further, according to the above configuration of the present invention, the packing body has a face plate portion locate toward the top plate portion beyond the ring-shaped protrusion, and the overhanging portion of the container body may be in close contact with the face plate portion.

The face plate portion of the packing is preferably in close contact with the inner surface of the lid body (including the opening edge portion of the lid body), and is preferably formed into a disk shape or a ring shape, but the shape should not be so limited as such.

Effects of the Invention

According to the present invention, since a bursting sound is generated when the lid body is attached to the container body, it is possible to know for sure that the opening of the container body has been exactly brought into close contact with the packing by virtue of this bursting sound.

BRIEF DESCRIPTION OF DRAWINGS

FIG. 1 is a half cross-sectional view of a sealed container according to an embodiment of the present invention.

FIG. 2 is a half cross-sectional view of a packing according to an embodiment of the present invention.

FIG. 3 is an enlarged view of X-circle portion in FIG. 1.

DESCRIPTION OF EMBODIMENTS

Hereinafter, embodiments of the present invention will be described with reference to the drawings.

FIG. 1 is a half cross-sectional view of a sealed container of the present embodiment, FIG. 2 is a half cross-sectional view of the packing, and FIG. 3 is an enlarged view of X-circle portion of FIG. 1.

As shown in FIG. 1, the sealed container 1 of the present embodiment includes a bottomed cylindrical container body 10, a ceiling-equipped cylindrical lid body 20 attached to the opening of the container body 10, and a packing 30 fitted inside the lid body 20.

The container body 10 includes a cylindrical body portion 11 and a circular bottom portion 12 located on the bottom of body portion 11, with the body portion 11 and the bottom portion 12 being integrated together by a metal such as aluminum. The body portion 11 has an overhanging portion 11*a* formed by protruding radially and inwardly from the upper edge of the opening of the container body. The overhanging portion 11*a* is formed such that its upper surface and inner side surface are substantially in an arc shape in a cross-sectional view.

On the other hand, the container body 10 does not have to be limited to metal such as aluminum, but may be made of other metal, or may be made of resin, wood, glass, or the like. Further, the body portion 11 and the bottom portion 12 may be made separately and independently from each other.

The lid body 20 has a cylindrical body portion 21 and a circular top plate portion 22 provided at the top of the body portion 21, with the body portion 21 and the top plate portion 22 being integrated together by a metal such as aluminum. Further, the top plate portion 22 is formed such that its top surface is gently curved and protruding upwardly, with the top plate portion 22 and the body portion 21 connected with each other via a smooth curved surface (R surface). Further, the diameter of the inner peripheral surface of the body portion 21 of the lid body 20 is slightly larger than the diameter of the outer peripheral surface of the body portion 11 of the container body 10, so that the body portion 21 of the lid body 20 can be attached to the body portion 11 of the container body 10 in a substantially rubbing relation.

On the other hand, the container body 10 and the lid body 20 are not limited to the circular cylindrical shape, but can also be square cylindrical, elliptical cylindrical, oval cylindrical, or the like.

As shown in FIGS. 1-3, the packing 30 includes a packing body 31 having a face plate portion 32 formed in a disk shape or a ring shape and three flexible fold-arranged circular ring-shaped protrusions 33, 34, 35 provided on the packing body 31 which are separated from the face plate portion 32 in the axial direction of the lid body 20 and are protruding in the radial direction, with the packing 30 being integrally formed from a flexible resin or rubber. On the other hand, since there may be a plurality of ring-shaped protrusions, it is possible to have two or more, four or more such protrusions. Further, when the packing 30 is attached to the lid body 20, the axial direction of the lid body 20 and the axial direction of the packing body 31 are the same.

Further, as described above, when the lid body 20 has a square cylindrical shape, an elliptical cylindrical shape, an oval cylindrical shape, or the like, the face plate portion may be a polygonal shape (including a triangular shape and a quadrangular shape), elliptical shape, or oval disc shape, while ring-shaped protrusions 33, 34, 35 may also be polygonal ring shape (including triangular ring shape and quadrangular ring shape), elliptical ring shape, or oval ring shape.

The packing body 31 has a substantially cylindrical body portion 31*a*, while a face plate portion 32 is coaxially provided at the upper end of the body portion 31*a*. The face plate portion 32 is so formed that its upper surface is gently curved and protruding upwardly, with its upper surface and the outer peripheral side surface being connected together through a smooth curved surface (R surface).

Further, the upper surface, the outer peripheral side surface, and the smooth curved surface (R surface) (connecting the above surfaces together) of the face plate portion 32 are respectively in close contact with the inner surface of the top plate portion 22, the upper inner peripheral surface of the body portion 21, and a smooth curved surface (R surface) (connecting the above surfaces of the lid body 20).

Moreover, in a state where the lid body 20 having the packing 30 (packing-equipped lid body 20A) has been attached to the container body 10, the overhanging portion 11*a*, which is the opening edge portion of the container body 10, is in close contact with the lower surface of the face plate portion 32 of the packing body 31, on its outer peripheral side beyond the body portion 31*a*.

Further, the inner peripheral surface of the body portion 31*a* of the packing 30 is inclined with respect to the axial direction of the body portion 31*a*, in a manner such that its diameter becomes larger toward the lower side.

Moreover, on the outer peripheral surface of the body portion 31*a*, three ring-shaped protrusions 33, 34, 35 are provided at predetermined intervals in the axial direction of the body portion 31*a* (axial direction of the lid body 20). The outer peripheral portion of the ring-shaped protrusion 33, which is the third from the top and is farthest from the top plate portion 22 of the lid body 20 (face plate portion 32 of the packing body 31) in the axial direction, is in close contact with the inner peripheral surface of the upper end portion of the body portion 11 of the container body 10, while the other two ring-shaped protrusions 34, 35 are arranged more radially separated from the inner peripheral surface of the body portion 11 when approaching closer to the face plate portion 32.

In other words, the three ring-shaped protrusions 33, 34, 35 are formed such that their diameters of the outer peripheral portions are shorter when getting closer the face plate portion 32, while the outer peripheral portion of the ring-shaped protrusion 33 on the side farthest from the face plate portion 32 is in close contact with the inner peripheral surface of the body portion 11 of the container body 10, with the other two ring-shaped protrusions 34, 35 not in close contact with the inner peripheral surface of the body portion 11, but being radially spaced apart from the inner peripheral surface.

Further, the outer peripheral portions of the other two ring-shaped protrusions 34, 35 are radially separated from the inner peripheral surface of the body portion 11 of the container body 10. Moreover, the outer peripheral portions of the ring-shaped protrusions 34, 35 are disposed radially outward beyond the tip edge (inner peripheral tip edge) of the ring-shaped overhanging portion 11*a*, which is so formed that it projects radially inward in the opening edge portion of the container body 10.

Further, the outer peripheral portions of the three ring-shaped protrusions 33, 34, 35 are formed into an arc shape when viewed in cross section, while the outer peripheral portion of the ring-shaped protrusion 33, which is in close contact with the inner peripheral surface of the body portion 11, is forced to be in close contact (by pressure) with the inner peripheral surface of the body portion 11, such that its arc-shaped (in cross section) portion is elastically crushed, thereby ensuring an airtightness for the sealed container 1. Further, when the ring-shaped protrusion 33 is deformed to be elastically bent against the face plate portion 32, the outer peripheral portion of the ring-shaped protrusion 33 will be brought into close contact (by pressure) with the inner peripheral surface of the body portion 11, thus exactly ensuring an airtightness for the sealed container 1.

A distance between the outer peripheral edge of the ring-shaped protrusion 34 (which is the second from the top) and the inner peripheral surface of the body portion 11 is substantially equal to the radial height of the ring-shaped protrusion 34 (which is a radial height of the ring-shaped protrusion 34 extending from the outer peripheral surface of the body portion 31*a* of the packing body 31).

Further, the uppermost ring-shaped protrusion 35 is slightly lower in radial height (for example, about 0.2 mm) than the ring-shaped protrusion 34. The diameters of the outer peripheral surfaces 31*b*, 31*c* of the body portion 31*a* of the packing main body 31 are different from each other, with the ring-shaped protrusion 35 located therebetween. Moreover, the diameter of the outer peripheral surface 31*b* above the ring-shaped protrusion 35 is larger than the diameter of the lower outer peripheral surface 31*c*.

Further, the axial intervals between the three ring-shaped protrusions 33, 34, and 35 adjacent to each other in the axial direction are substantially equal to one another. Namely, an interval between the ring-shaped protrusions 33, 34 is substantially equal to an interval between the ring-shaped protrusions 34, 35.

What is necessary here is that the outer peripheral portions of the ring-shaped protrusions 34, 35 are spaced apart from the inner peripheral surface of the body portion 11 of the container body 10 in the radial direction, and that the diameters of the outer peripheral portions are smaller than the diameter of the outer peripheral portion of the ring-shaped protrusion 33. Further, in the present embodiment, although the diameter of the outer peripheral portion of the ring-shaped protrusion 35 is smaller than the diameter of the outer peripheral portion of the ring-shaped protrusion 34, it is also possible for them to be equal to each other, and it is further possible for the diameter of the outer peripheral portion of the ring-shaped protrusion 35 to be larger than the diameter of the outer peripheral portion of the ring-shaped protrusion 34.

Moreover, although the present embodiment employs three ring-shaped protrusions 33, 34, 35, and requires that the outer peripheral portion of the ring-shaped protrusion 33 is in close contact with the inner peripheral surface of the body portion 11 of the container body 10, it is also possible for the outer peripheral portion of the ring-shaped protrusion 34 to be in close contact with the inner peripheral surface of the body portion 11 of the container body 10.

In short, among the several ring-shaped protrusions, the ring-shaped protrusion that is the farthest from the top plate portion 22 of the lid body 20 in the axial direction is in close contact with the inner peripheral surface of the body portion 11. Further, among other ring-shaped protrusions, at least one ring-shaped protrusion may have its outer peripheral portion to be spaced apart from the inner peripheral surface of the body portion 11 of the container body 10, and to be further located radially outward beyond the tip edge of the overhanging portion 11*a* formed in the opening edge portion of the container body 10, with other ring-shaped protrusions being in close contact with the inner peripheral surface of the body portion 11.

The packing-equipped lid body 20A according to the present embodiment is configured by attaching the packing 30 inside the lid body 20 as described above.

Then, when the packing-equipped lid body 20A is attached to the container body 10, the overhanging portion

11*a* at the upper end of the container body 10 protrudes through a space between the ring-shaped protrusion 33 (located farthest in the axial direction from the top plate portion 22 of the lid body 20) and the body portion 21 of the lid body 20, and gets into close contact with the lower surface of the face plate portion 32 of the packing 30. Meanwhile, the outer peripheral portion of the ring-shaped protrusion 33 is in close contact with the inner peripheral surface of the body portion 11 of the container body 10, thereby ensuring a desired airtightness for the sealed container 1.

Further, when the packing-equipped lid body 20A is attached to the container body 10, at first, the outer peripheral portion of the ring-shaped protrusion 33 (that is the farthest from the top plate portion 22 of the lid body 20 in the axial direction) is brought into close contact with the inner peripheral surface of the body portion 11 of the container body 10, while the outer peripheral portion of the ring-shaped protrusion 33 approaches other ring-shaped protrusions 34, 35 due to the flexibility of the ring-shaped protrusion 33. In this way, when the air between the packing 30 and the container body 10 is compressed and the peripheral portions of other ring-shaped protrusions 34, 35 move beyond the overhanging portion 11*a* of the container body 10, the outer peripheral portions of other ring-shaped protrusions 34, 35 will be elastically bent and then elastically restored, so that other ring-shaped protrusions 34, 35 will vibrate, and the compressed air is released to the outside through the outer peripheral portion of the container body 10 and the inner peripheral portion of the lid body 20, thus producing a bursting sound. In particular, when the diameter of the outer peripheral portion of the ring-shaped protrusion 34 is larger than the diameter of the outer peripheral portion of the ring-shaped protrusion 35, this bursting sound becomes louder at the timing when the outer peripheral portion of the ring-shaped protrusion 35 exceeds the overhanging portion 11*a* of the container body 10.

As described above, according to the present embodiment, when the lid body 20 (packing-equipped lid body 20A) is attached to the container body 10, since a bursting sound is generated, it becomes possible to find, byway of bursting sound, that the opening of the container body 10 has gotten into close contact with the packing 30, thereby ensuring an airtightness for the sealed container.

Further, the packing body 31 has a face plate portion 32, and the opening edge portion (overhanging portion 11*a*) of the container body 10 is in close contact with the face plate portion 32, thus ensuring a desired airtightness for the sealed container 1 by virtue of the closely contacted portions.

EXPLANATIONS OF REFERENCE NUMERALS

1 sealed container
10 container body
11*a* overhanging portion
20 lid body
20A packing-equipped lid body
22 top plate portion
30 packing
31 packing body
32 face plate portion
33, 34, 35 ring-shaped protrusion

The invention claimed is:

1. A sealed container including a bottomed cylindrical container body, a ceiling-equipped cylindrical lid body attached to an opening of the container body, and a packing attached to the lid body, wherein the packing has a packing body provided in the lid body and three flexible ring-shaped protrusions provided on the packing body which are mutually separated in the axial direction of the lid body and protruding in a radial direction, the three ring-shaped protrusions have the diameters of their outer peripheral portions to be smaller towards a top plate portion of the lid body, the outer peripheral portion of one of the ring-shaped protrusions, which is farthest from the top plate portion of the lid body in the axial direction, is in close contact with the inner peripheral surface of the container body, and other ring-shaped protrusions have their outer peripheral portion to be radially separated from the inner peripheral surface of the container body and to be located radially outwardly beyond the tip edge of the ring-shaped overhanging portion, which has been formed protruding radially inwardly in the opening edge portion of the container body.

2. The sealed container according to claim 1, wherein the packing body has a face plate portion located towards the top plate portion beyond the ring-shaped protrusions, the overhanging portion of the container body is in close contact with the face plate portion.

3. A packing for being attached to a ceiling-equipped cylindrical lid body which is to be attached to an opening of a bottomed cylindrical container body, said packing comprising:

a packing body to be provided in the lid body;

three flexible ring-shaped protrusions provided on the packing body which are mutually separated in the axial direction of the lid body and protruding in a radial direction, wherein the three ring-shaped protrusions have the diameters of their outer peripheral portions to be smaller towards a top plate portion of the lid body, when the lid body with the packing has been attached to the opening of the container body, the outer peripheral portion of one of the ring-shaped protrusions, which is farthest from the top plate portion of the lid body in the axial direction, is in close contact with the inner peripheral surface of the container body, and other ring-shaped protrusions have their outer peripheral portions to be radially separated from the inner peripheral surface of the container body and to be located radially outwardly beyond the tip edge of the ring-shaped overhanging portion, which has been formed protruding radially inwardly in the opening edge portion of the container body.

4. The packing according to claim 3, wherein the packing body has a face plate portion that is in close contact with the inner surface of the lid body.

5. A packing-equipped lid body, comprising: a ceiling-equipped cylindrical lid body; and a packing of claim 3 which has been attached into the lid body.

* * * * *